United States Patent [19]

Goldhammer

[11] Patent Number: 4,627,582

[45] Date of Patent: Dec. 9, 1986

[54] APPARATUS FOR COMMINUTION OF WASTE MATERIAL SUCH AS PAPER BLOCKS

[75] Inventor: Albert Goldhammer, Uberlingen, Fed. Rep. of Germany

[73] Assignee: Firma Feinwerktechnik Schliecher & Co., Markdoff, Fed. Rep. of Germany

[21] Appl. No.: 700,911

[22] Filed: Feb. 12, 1985

Related U.S. Application Data

[63] Continuation-in-part of Ser. No. 362,466, Mar. 26, 1982, abandoned.

[30] Foreign Application Priority Data

Mar. 30, 1981 [DE] Fed. Rep. of Germany ..... 3112639

[51] Int. Cl.[4] ..... B02L 18/06

[52] U.S. Cl. ..... 241/236

[58] Field of Search ..... 241/222–225, 241/235, 236, 242, 243

[56] References Cited

U.S. PATENT DOCUMENTS 1,551,875 9/1925 Hall ..... 241/236 X 3,860,180 1/1975 Goldhammer ..... 241/236 X

*Primary Examiner*—Howard N. Goldberg
*Assistant Examiner*—Timothy V. Eley
*Attorney, Agent, or Firm*—Lackenbach Siegel Marzullo Presta & Aronson

[57] ABSTRACT

This invention relates to an apparatus for comminuting waste material comprising two driven and meshing cutter blocks formed from knife disks provided with recesses running in a transverse direction that cut into the knife disk surface. The apparatus can destroy or shred waste material such as paper files with a back width of about 7 centimeters without having to remove in advance metal clamping devices typical for files and file folders. The recesses provide an inclined running saw tooth profile, which continues as a staggered, or angled, profile in the neighboring knife disk; and each disk is provided with a saw tooth profile having inclined tooth sides enclosing an acute angle of approximately 80 degrees. Each tooth also has a cutting side, which at the same time forms a sliding surface for the waste material. A groove trailing each set of recesses cuts the elongated strips into short strips on the outlet side of the cutter blocks.

9 Claims, 4 Drawing Figures

APPARATUS FOR COMMINUTION OF WASTE MATERIAL SUCH AS PAPER BLOCKS

This application is a continuation-in-part of application No. 362,466, filed Mar. 26, 1982, now abandoned.

This invention relates to an apparatus for the comminution of waste material such as paper blocks. The apparatus comprises two driven and meshing cutter blocks formed from cutting disks, which are provided with recesses running in a transverse direction and into the knife disk surfaces.

SUMMARY OF THE INVENTION

Businesses and government offices often prefer to shred files that have been designated for destruction prior to having the files leave company premises. Shredding is accomplished by sending the files through paper shredders. Simple and unsophisticated devices strip the blocks of paper sheets into multiple elongated strips. Because it is known that such strips could be reassembled, more sophisticated shredders are known that not only cut the paper into elongated strips, but also cross-cut the elongated strips into a larger number of small strips so that the files cannot be reconstructed. These sophisticated shredders, however, cannot shred thick folders of files, especially if they are clamped together by any metal clamping devices contained in the files, such as paper clips, staples, and file clamps of the type having the trade name Acco which are used to attach documents to a file folder after the document files have been prepared by a two-hole punch, and would be quickly dulled by the clamping devices.

It is an object of the present invention to provide an apparatus for the comminution of office waste material such as file folders holding documents having a back width of about 7 centimeters without the requirement of first having metal clamping mechanisms removed first. Such metal clamping mechanisms, which have relatively thick metal parts, cannot be processed in regular comminution apparatus, since these apparatus are capable of comminuting only paper material, that is, these apparatus cannot comminute metal clamps.

It is common to have blocks of 200 to 400 documents contained in each file along with staples, paper clips, and metal clamps; such blocks cannot be comminuted with conventional cutting, or shredding devices. In the context of shredding activity, comminution should be performed within a relatively short time interval so that the complete file folder can be entered as a single block of paper, and so that the elongated strips are snipped into short pieces and the total shredding process results in security obligations relating to the documents are sufficiently met.

The object of the invention is achieved by providing that the recesses form an inclined running saw tooth profile, which is continued in the neighboring disk as an intermittent, or staggered, inclined profile.

Another emboiment of the invention provides additional grooves in the knife disks so as to shear off the elongated, or spaghetti-shaped, strips of paper into short strips.

Known shredding or comminuting, apparatus are simply not capable of cutting, or tearing to shreds, large stacks of paper together with a file folder with metal fasteners without the rollers of becoming stuck, or locked, during the process.

In addition, the disk cutters of known apparatus become dulled by the metal.

An apparatus for destroying documents is described in U.S. Pat. No. 3,860,180, issued to Albert Goldhammer on Jan. 14, 1975. This apparatus, however, is not capable of shredding documents in a folder of more than about 50 sheet, especially if the folder includes metal fasteners that clip the documents to one another to this file folder.

Other apparatuses for cutting up material are described in the following patents:

U.S. Pat. No. 4,194,699 issued Mar. 25, 1980 to Berthelsen;

U.S. Pat. No. 4,052,013 issued Oct. 4, 1977 to Ehrlich, et al.;

U.S. Pat. No. 4,219,291 issued Aug. 26, 1980 to Hoeh;

German Patent No. 1,511,164 issued Apr. 24, 1975 to Ehinger;

German Patent No. 2,526,109 issued Jan. 26, 1978 to Goldhammer;

British Patent No. 1,389,993 issued Apr. 9, 1975 to Goldhammer;

British Patent No. 1,392,319 issued Apr. 30, 1975 to Haeberle;

British Patent No. 1,485,920 issued Sept. 14, 1977 to Goldhammer; and

French Patent No. 1,226,633 issued Feb. 29, 1960 to Brocard.

None of the above patents discloses a shredding structure capable of shredding metal paper and file fastners.

BRIEF DESCRIPTION OF THE DRAWINGS

The drawings show the preferred embodiment of the invention and its novel features are more clearly shown and set forth in the accompanying description.

DESCRIPTION OF THE PREFERRED EMBODIMENTS

Figure 2:
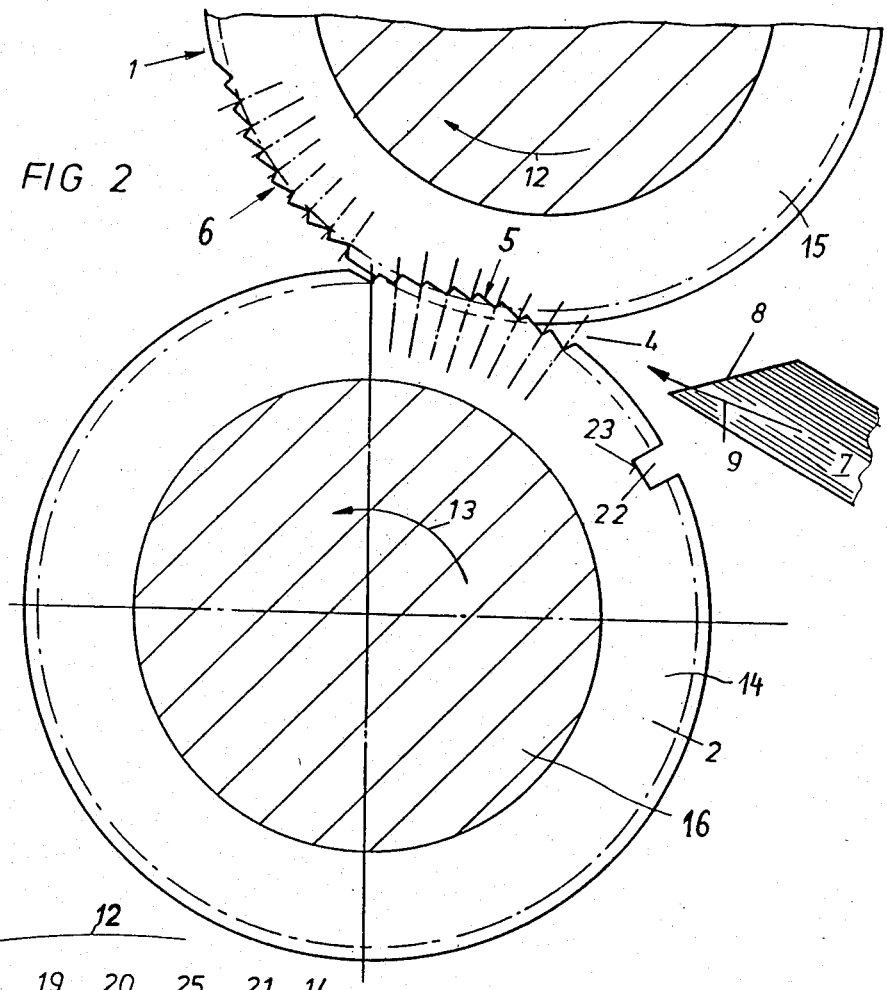
FIG. 2 is a sectional view taken along line I—I of FIG. 1.
Figure 4:
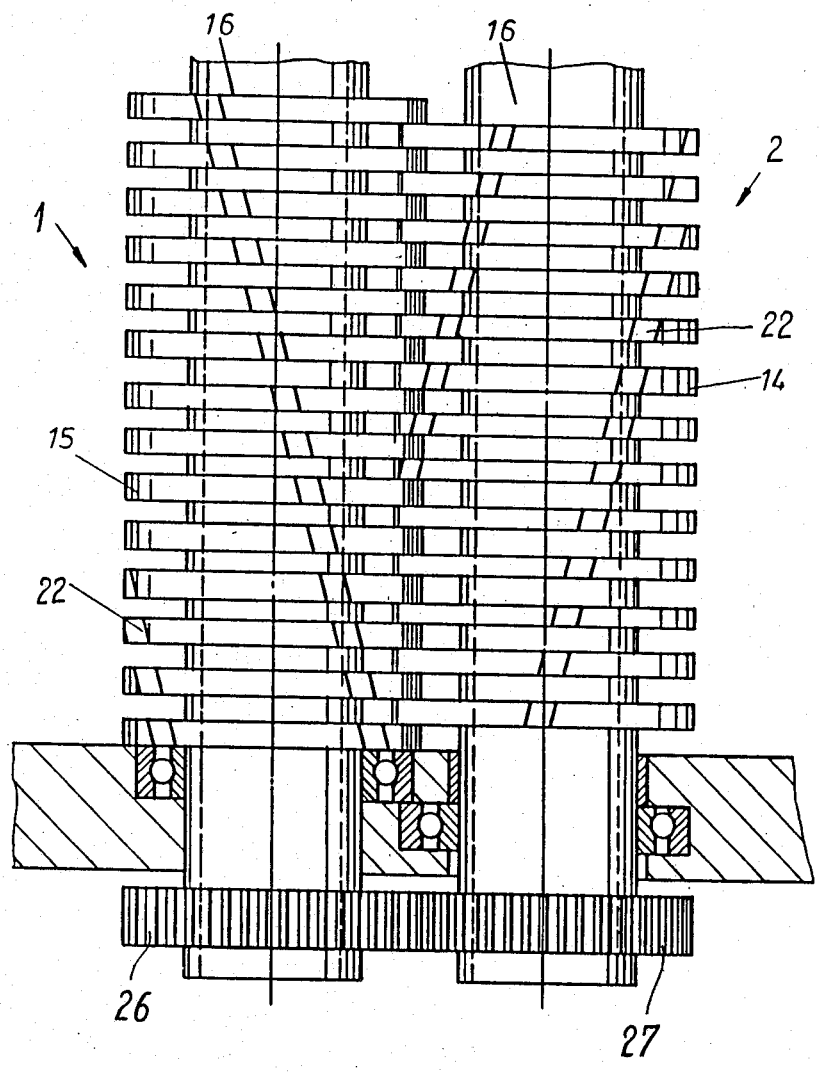
FIG. 4 is an elevational view showing a pair of cutting blocks meshing together with their driving gearing.

Reference is now made in detail to the drawings. As shown in FIGS. 2 and 4, a paper block, or stack, 7 is drawn in the direction of arrow 9 into a roller slot 4, due to helical profiles saw tooth 5 and 6 at rotatable cutter blocks 1 and 2.

Figure 3:
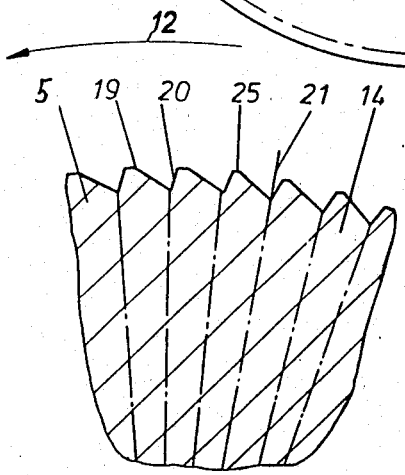
FIG. 3 is an enlarged, fragmentary detail of the construction of the saw tooth profile.

It is particularly essential that the saw tooth profile is dull, as is best shown in FIG. 3. That is, the tip 25 of each tooth is removed, so that the tip cannot be broken off and so clog the rollers. Breaking off of sharp tips can occur upon such tips gripping metal fasteners or parts that either hold the papers to a file folder or hold the papers one to another.

Figure 1:
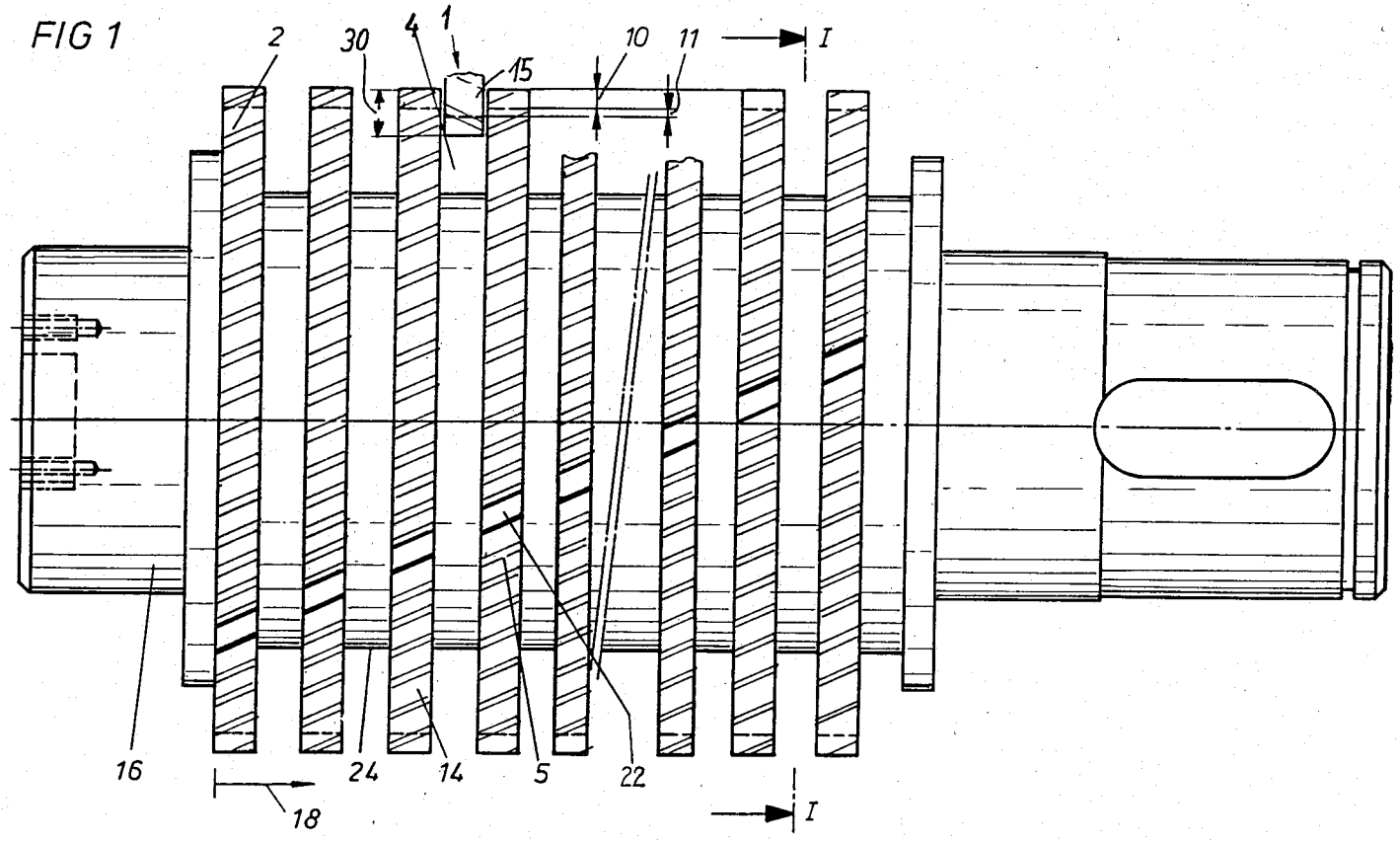
FIG. 1 is a fragmentary elevational view of the present invention.

Cutter rollers, or blocks, 1 and 2 can be made from one piece, which can be milled out of roller core 16. Alternatively, cutter blocks 1 and 2 can be formed from a plurality of knife disks 14 and 15; the disks can then be slid onto a core so that they are disposed at equal distances one from another by insertion of tubular spacer blocks. This distance, which is also the overlap of the saw teeth between the meshing cutter blocks 1 and 2, corresponds to two times the height of the saw teeth calculated from the apex of each tooth to the base of each tooth plus about 1 millimeter. This relationship is shown in FIG. 1. This overlap is necessary in order to assure a penetration effect, or penetration process, of the saw tooth profile into the paper material being shredded, that is, so that one saw tooth profile of one roller block penetrates the paper so the paper is retained by the other knife and disk which has already penetrated the paper. It is noted that this process of penetration of the paper by the saw tooth profiles performs the task of cross-tearing, or cutting, the paper prior in time to the longitudinal cutting the paper into strips. As the cutter blocks 1 and 2 rotate, the longitudinal cutting starts at the edges of the cross-tear described above; the longitudinal cutting is also continued in the following region, so that continuous longitudinal cuts are accomplished by the top and bottom edges of neighboring knife disks 14 and 15.

As shown in FIG. 1, knife disks 14 and 15 are slid onto roller core 16 so that they are separated by interspaces 24. The saw teeth are disposed in staggered, or helical, profiles 5 and 6, which are also seen in FIG. 2. Roller slot 4, described previously, form roller slot 4. Paper stack 7 is slid in the direction of arrow 9 into roller slot 4 by an operator. The direction of rotation of the oppositely operated cutter blocks 1 and 2 are shown by arrows 12 and 13, respectively. That is, if paper stack 7 is in position as shown in FIG. 2, then the stack is drawn in the direction of arrow 9 into roller slot 4 with a component of movement in direction of arrow 18 (FIG. 1) by the helically disposed saw teeth and the correspondingly selected distance 11.

The saw tooth profiles seen in FIG. 3 include a flatter lagging tooth side 19 and a steeper leading tooth side 20. Lagging tooth side 19 forms an angle of approximately 80 degrees with the radius 21 of knife disk 14, while the adjacent steeper cutting side encloses an angle of 20 degrees therewith, where the tapered base of the saw tooth profile acts to transport the cut paper material further immediately upon the cutting of the paper without clogging the profile. As before mentioned, the teeth have dull tips 25, the sharp edge of which have been removed. Lagging and leading tooth sides 19 and 20 each have inclined sides, each having an angle of inclination relative to radius 21. The angle of inclination of the side of leading side 20 is greater than the angle of inclination of lagging side 19, but not undercut or backsloped in order to release easily the cut or milled particles.

A notch, or groove, 22 shown in FIG. 2 is essential to the best operation of cutter blocks 1 and 2. Groove 22 is formed at the periphery of each disk 14 and 15 at the trailing side of the saw tooth profile. Groove 22 serves to rip, or to tear up, the spaghetti-like, bulging out paper strips from the outgoing side of cutter blocks 1 and 2 opposite roller slot 4. Groove 22 is provided with a wide base 23 and is also helically disposed at the same angle as the saw tooth profile 5 and 6.

The helical profiles of groove 22 can be disposed between the saw tooth profiles 5 and 6, which are likewise disposed as helical profiles, as described earlier. Also, as seen in FIG. 1, the overlapping distance 11 of the roots of the teeth of about 1 mm is dependent upon the height of the teeth and may vary somewhat in each case, especially with different overall dimensions of the cutting blocks.

The term modulus is known in the art and is defined here as being the graduation of a gear (the distance between two teeth divided by (3.14). Thus, a modulus of 2 to 3 mm means the following: graduation t = modulus m x = 2(or 3) × 3.14 = 6.28 to 9.42 mm. This modulus is advantageous for a combined action of sawing and gripping the sheets of stack 7. A measure of the distance between the teeth defines the relative finess or coarseness of the saw.

It is essential that the overlap mesh 30 of the teeth is in accordance with a modulus that may vary between 2 mm and 3 mm. The total overlap mesh 30 is twice the teeth height plus root overlapping 11 or, in other terms, the diameter of the cutter disks 14 and 15, minus the distance of the axis' of the cutter blocks 1 and 2. As shown in FIG. 4, cutter blocks 1 and 2 can be driven by a method known in the art by way of toothed gears 26 and 27.

In operation, cutting rollers 1, 2 are driven by the gears 26, 27 in the direction of the arrows 12 and 13 to draw material into the slot 4. The paper stack 7 as shown in FIG. 2 is too thick to pass into roller slot or gap 4. If the paper pile 7 consists of loose sheet, it is transformed into a tip 8 formed and milled off by way of the saw tooth profile, seen in detail in FIG. 3. In this manner an automatic portioning is effected since the saw tooth profile grips paper pile 7 at every tip 8 that is formed, with the most forward of the tips moving to the middle of stack 7 for milling by the saw tooth profile between operational cutting modes when no cutting action at the saw tooth profile is occuring so that stack 7 is continuously drawn in the same manner into roller slot 4. The other sheets of paper stay behind and organize themselves once again with tip 8 being milled to the position as seen in FIG. 2. This process runs continuously and repeatedly, so that as the sheets are drawn between the rollers, the stack of papers becomes thinner and thinner. Each group of sheets is drawn at a certain thickness of sheets into roller slot 4 and cut to pieces between the rollers. A motor driver of about 4 kilowatts has proven sufficient to produce run-through speeds of 15 to 20 centimeters a second. If a paper pile 7 of considerable thickness of more than about 50 sheets, which is bound or clamped by staples, clamps or the like, is fed in the direction of arrow 19 (FIG. 2), it can no more be shredded in an usual way because it cannot be transported through roller slot 4, which is narrower than the pile 7. In the invention the saw tooth profile 5, 6 on the periphery of the disks 14, 15 saw or mill into the pile 7, whereby here also the front edge of the paper pile 7 is transformed into a tip. Every time when a groove 22 passes, its edge chops or bites into the pile and pushes it strongly to the slot 4. If the pile is still too thick to be transported through the cutting slot 4 entirely, the edges of the groove 22 tear off some of the sheets at the side of the pile and, while passing the side of the tip, roughens it and provides a surface which has good properties for the continued sawing action of the following saw teeth sector.

It will be seen that thereby a pulsating sawing / tearing / transporting action is performed which exerts various kinds of destructive forces and actions to the pile even if it is clamped to a solid block. The thick pile is milled off but at each time a groove 22 passes, it tries whether it is already possible to draw the pile 7 through the gap entirely. By the pulsating action the pile will be also frequently repositioned or turned. Metal fasteners, staples or clamping devices will be torn out or crushed or sawn by the dulled tips or the saw teeth, which will not be damaged. The dulled teeth exert a controlled drawing action on the pile and prevent blocking of the rollers, which would be possible if a very sharp saw profile would draw a thick pile into the gap, especially if the pulsating transport action of the invention would not be present.

If the pile is sufficently milled or torn off to pass the cutting gap 4, it will be cut between the adjacent disks 14, 15 into spaghetti-strips which are torn apart into particles by the action of the grooves 22 in the slot 4. This kind of cutting action will also take place if thin piles or single sheet are fed to the apparatus.

It may be observed that the appartus of the invention carries out different sawing, cutting, transporting and portioning actions, which themselves automatically adapt to the kind of material to be shredded. Thereby the apparatus shredds nearly all kinds of loose or bound documents and piles.

With the above description of the embodiment, a problem-free flow of shredded paper along with metal clips and fasteners is achieved.

The convergingly inclined sides of the saw tooth profile with the inclined sides 20 and 21 as well as dull tip 25 are essential for their function of transporting and sawing paper 7 without having the paper clog or block the cutters. In the described combination of saw teeth and notches 20 it has been found that paper blocks up to 300 sheets can be cut without clogging the apparatus. In the Goldhammer apparatus described in Pat. No. 3,860,180, it can handle paper blocks up to only about 50 sheets without clogging. With regard to patent '180, it is noted that nose 7 acts as a means for separating the cut strips into particles by tearing the strips at the place of the notch into pieces.

Although the present invention has been described in some detail by way of illustration and example for purposes of clarity and understanding, it will, of course, be understood that various changes and modifications may be made in the form, details, and arrangements of the parts without departing from the scope of the invention set forth in the following claims.

What is claimed is:

1. An apparatus for the comminution of waste material, suchs as thick paper blocks, which can include metal fasteners and a plurality of sheets greater than 50 in number; comprising:

opposing cutter blocks mounted in parallel and driven in counter-rotating directions in meshing relationship with regard to each other, each cutter block having a plurality of knife disks of generally cylindrical configuration spaced from each other and intermeshing with a plurality of similar knife disks of an adjacent cutter block so as to provide primarily scissor-like knife cuts to said waste materials, each of said knife disks of said cutter blocks having at its outer circumference a plurality of teeth provided with a saw-tooth profile, and said teeth having two convergingly inclined sides which are spaced apart at a top edge, said saw tooth profile performing a sawing action on said waste material when same is in near to clogging positions between said opposing cutter blocks, said inclined sides including a leading inclined side and a lagging inclined side, said leading and lagging inclined sides each having an angle of predetermined inclination, the angle of inclination of said leading inclined side being greater than the angle of inclination of said lagging inclined side, both of said inclined sides having therebetween said top edge forming a dull tip for each tooth; the top edge having, in circumferential direction, smaller dimensions than the distance between two adjacent top edges of the same knife disk, the axial length of said top edge being the same as the thickness of the generally cylindrical knife disk, and each said knife disk having at least one groove with a groove bottom, said at least one groove being formed at the periphery of each said knife disk and at the trailing side of the saw tooth profile, and said groove bottom forming a wide base which is at least as wide as the distance between two adjacent top edges, said grooves being spaced from each other and interrupting the toothed outer circumference of said knife disk;

whereby said cutter blocks do not seize or jam when in use comminuting waste material even despite thick paper blocks having metal fasteners therein and more than 50 sheets, inasmuch as the toothed circumferences including the inclined sides and the dull tips of the teeth in combination with the grooves grab and draw said paper blocks into the opposing meshing cutter blocks in an incremental manner with a tip being formed continuously and repeatedly as sheets are drawn between said cutter blocks and the paper blocks become thinner and thinner, and such comminuting being formed without the need for any external forces bearing on or pressing said waste material against said cutter blocks.

2. The apparatus according to claim 1, wherein each said tooth has a cutting side which encloses with the radius of the knife disk and an angle of 20°.

3. The apparatus according to claim 2, wherein said inclined sides of said saw-tooth profile enclose an angle of 80°.

4. The apparatus according to claim 2, wherein each said tooth has a cutting side which is not back-sloped.

5. The apparatus according to claim 1, wherein said grooves are arranged in adjacent knife disks of a cutter block so as to form at least one helically running interrupted slit.

6. The apparatus accordint to claim 1, wherein each tooth has a base and an apex, said teeth of adjacent knife disks of different cutter blocks overlapping each other by an amount two-times the height of the saw-teeth calculated from the apex to the base plus 1 mm.

7. The apparatus according to claim 1, wherein the modulus of said teeth is from approximately 2 mm to 3 mm.

8. The apparatus according to claim 1, wherein said cutter blocks comprise at least one pair of adjacent cutter blocks.

9. The apparatus according to claim 1, wherein the teeth of said saw tooth profile are arranged in adjacent knife disks of a cutter block so as to form helically running interrupted crests.

* * * * *